US007215915B2

(12) United States Patent
Baskin et al.

(10) Patent No.: US 7,215,915 B2
(45) Date of Patent: May 8, 2007

(54) METHOD AND APPARATUS FOR VARIABLE WIDTH SURFACE TREATMENT APPLICATION TO A FUSER

(75) Inventors: Michael K. Baskin, Springwater, NY (US); Richard C. Baughman, Geneseo, NY (US); Thomas J. Foster, Geneseo, NY (US); Borden H. Mills, III, Webster, NY (US); Terry N. Morganti, Brockport, NY (US)

(73) Assignee: Eastman Kodak Company, Rochester, NY (US)

( * ) Notice: Subject to any disclaimer, the term of this patent is extended or adjusted under 35 U.S.C. 154(b) by 132 days.

(21) Appl. No.: 11/024,134

(22) Filed: Dec. 28, 2004

(65) Prior Publication Data

US 2005/0169678 A1 Aug. 4, 2005

Related U.S. Application Data

(60) Provisional application No. 60/540,883, filed on Jan. 30, 2004.

(51) Int. Cl.
*G03G 15/20* (2006.01)

(52) U.S. Cl. ..... 399/324; 399/325; 399/326

(58) Field of Classification Search ..... 399/320, 399/324, 325, 326, 327
See application file for complete search history.

(56) References Cited

U.S. PATENT DOCUMENTS

| | | | | |
|---|---|---|---|---|
| 4,085,702 | A | | 4/1978 | Consaul et al. |
| 4,593,992 | A | | 6/1986 | Yoshinaga et al. |
| 5,235,394 | A | | 8/1993 | Mills, III et al. |
| 5,267,004 | A | | 11/1993 | Mills |
| 5,708,914 | A | * | 1/1998 | Mills et al. ..... 399/45 |
| 5,732,317 | A | | 3/1998 | Orchard, II et al. |
| 6,096,427 | A | | 8/2000 | Chen et al. |
| 6,317,577 | B1 | | 11/2001 | Baruch et al. |

FOREIGN PATENT DOCUMENTS

| | | |
|---|---|---|
| JP | 58 203472 | 11/1983 |
| JP | 04 330476 | 11/1992 |
| JP | 09 090799 | 4/1997 |
| JP | 2002 251093 | 6/2002 |
| JP | 2002 296944 | 9/2002 |

* cited by examiner

*Primary Examiner*—Hoang Ngo
(74) *Attorney, Agent, or Firm*—Donna P. Suchy

(57) ABSTRACT

The invention relates to application of a surface treatment to a fuser, typically in a print process. According to various aspects of the invention, methods and apparatus are provided for applying surface treatment to a fuser comprising varying a width of surface treatment application to the fuser.

31 Claims, 10 Drawing Sheets

METHOD AND APPARATUS FOR VARIABLE WIDTH SURFACE TREATMENT APPLICATION TO A FUSER

CROSS REFERENCE TO RELATED APPLICATIONS

This application claims the benefit of U.S. Provisional Application Ser. No. 60/540,883, filed Jan. 30, 2004, entitled METHOD AND APPARATUS FOR VARIABLE WIDTH SURFACE TREATMENT APPLICATION TO A FUSER by Michael K. Baskin, et al.

FIELD OF THE INVENTION

The invention relates to application of a surface treatment to a fuser, typically in a print process.

BACKGROUND OF THE INVENTION

Fuser oil is applied to the fuser roller so that toner does not stick to the fuser roller. The paper width determines the width of oil that should be laid down on the fuser roller. Currently, in one example of the art, oil is applied to the fuser roller in a fixed width, as determined by a rotating oil wick. There are 11 different wick sizes, ranging from 8.50 inches up to 14.00 inches in half-inch increments excluding 9.00 inches. When a customer changes paper sizes, the corresponding size wick should also be installed in the machine if that job is of significant size (number of pages). This prevents under oiling or over oiling of the fuser roller. Using an under size wick (under oiling) can result in toner sticking to the fuser roller. This will cause paper jams and eventual failure of the fuser roller and the wick itself. Using an over size wick (over oiling) will contaminate other portions of the electrophotographic process (transfer/film) and the web cleaner with excessive oil. Either under or over oiling can lead to expensive service calls.

The oiled length of a rotating wick is determined by an oil barrier between the porous ceramic core and the surface layer of the wick. Since all of the wicks look identical (with the exception of a different colored dot), it is difficult for a user to identify what size wick is in the machine. Furthermore, most users simply will not change wicks based on the job width size. Still further, since the machine can be loaded with many paper width size jobs that run consecutively without the machine stopping, there is no opportunity to stop and change the wick size. All of the above can lead to the failure modes mentioned.

SUMMARY OF THE INVENTION

According to various aspects of the invention, methods and apparatus are provided for applying surface treatment to a fuser comprising varying a width of surface treatment application to the fuser.

DETAILED DESCRIPTION OF THE INVENTION

Figure 1:
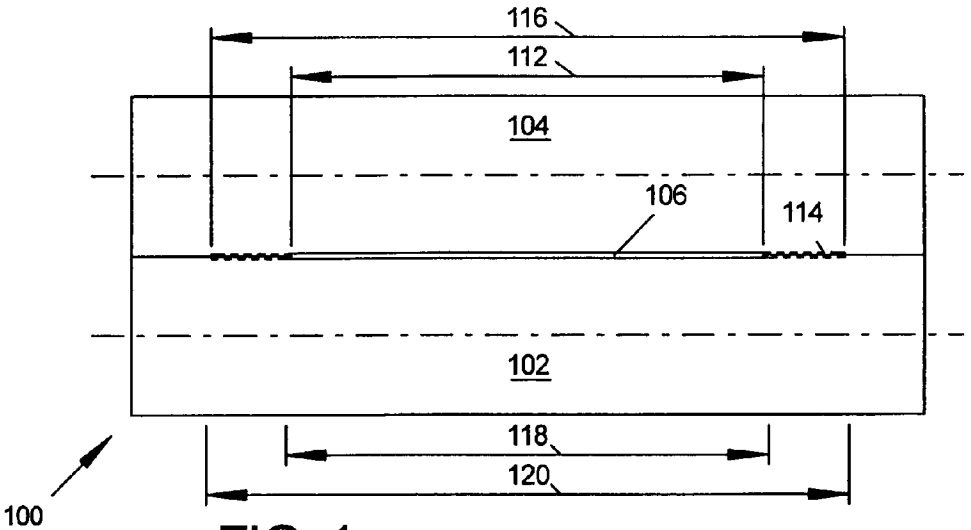
FIG. 1 presents a side schematic view of a method and apparatus according to one aspect of the invention.
Figure 3:
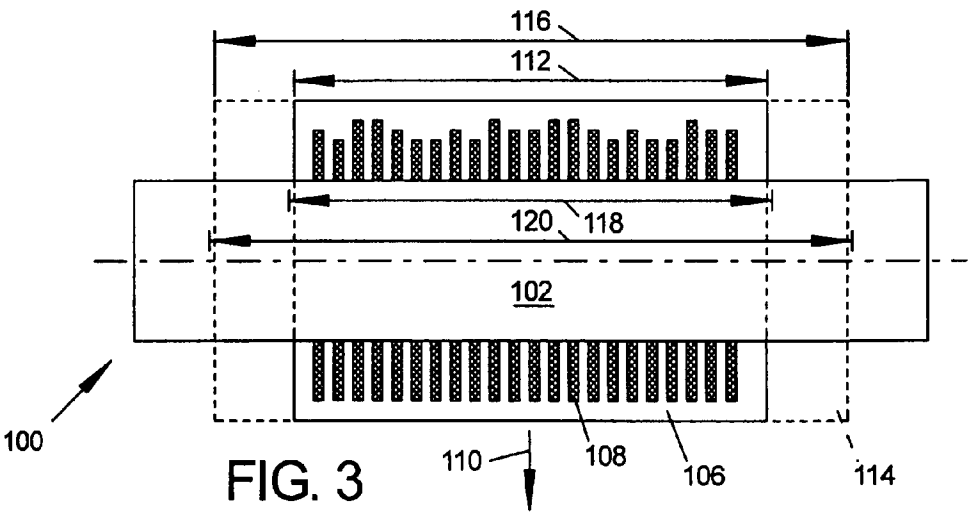
FIG. 3 presents a bottom view of the FIG. 1 method and apparatus.
Figure 2:
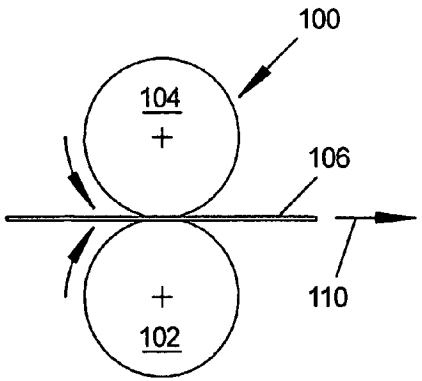
FIG. 2 presents an end view of the FIG. 1 method and apparatus.
Figure 14:
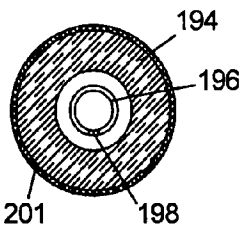
FIG. 14 presents a cross-sectional view of one embodiment of a suitable construction for an applicator.

Various aspects of the invention are presented with reference to FIGS. 1–24, which are not drawn to any particular scale, and wherein like components in the numerous views are numbered alike. Referring now specifically to FIGS. 1–3, an apparatus and method according to one aspect of the invention are depicted. A fuser assembly 100 is presented comprising a fuser 102 and a pressure roller 104, for example, of the type used in an electrographic process (for example an electrophotographic process, ionographic process, direct electrostatic printing process, etc.). The fuser 102 may take various forms including a roller (as shown in FIGS. 1–3) and a belt. The fuser 102 is heated, generally internally and/or externally, and may include a fuser body, which may be of any material, such as aluminum and may include a coating of low surface energy filled with conductive material, all of which is well known to those skilled in the art. It should be noted that the embodiment shown is illustrative only and a variety of combinations may be used for supporting, heating and driving the pressure roller 104, fuser 102 and, optionally, the heater rollers. The operation of such fuser rollers, pressure rollers and heater rollers is well known to those skilled in the art and need not be discussed further here. A media 106 bearing marking material 108, for example toner, is passed through a nip where the fuser 102 and the pressure roller 104 are in closest proximity to each other, the motion being indicated by arrow 110. Heat and pressure in the nip fuses the marking material 108 to the media 106. The width 112 of the media 106 may vary. A width 116 of another media 114, shown in dotted line, is presented in FIGS. 1 and 3.

According to one aspect of the invention, a method is provided of applying surface treatment to the fuser 102 comprising varying a width of surface treatment application to the fuser 102. The width may be varied as a function of media width. For example, a width 118 of surface treatment application may be implemented for media 106, and a different width 120 of surface treatment application may be implemented for media 114. The width of surface treatment application may be varied using a controller through an actuator, for example electrical, electromagnetic, pneumatic, and/or hydraulic actuators with gears linkages, cams, etc., as is apparent in light of the description provided herein. All such variations are contemplated in the practice of the invention.

According to a further aspect of the invention, a method is provided comprising applying surface treatment to the fuser 102 over a first width 112 corresponding to a predetermined first media size, and applying surface treatment to the fuser over a second width 120 corresponding to a second media size. The orientation of the media is determined in advance, so knowledge of the media size is sufficient to derive the width of the media.

Figure 4A:
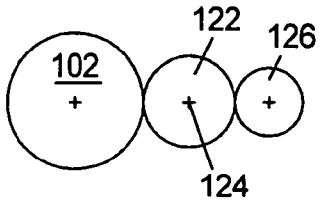
FIG. 4A presents an end schematic view of a method and apparatus according to one aspect of the invention.
Figure 4B:
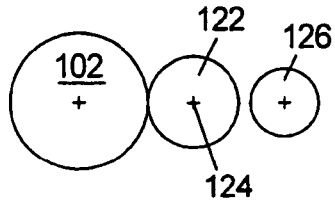
FIG. 4B presents an end schematic view of a method and apparatus according to one aspect of the invention.
Figure 5:
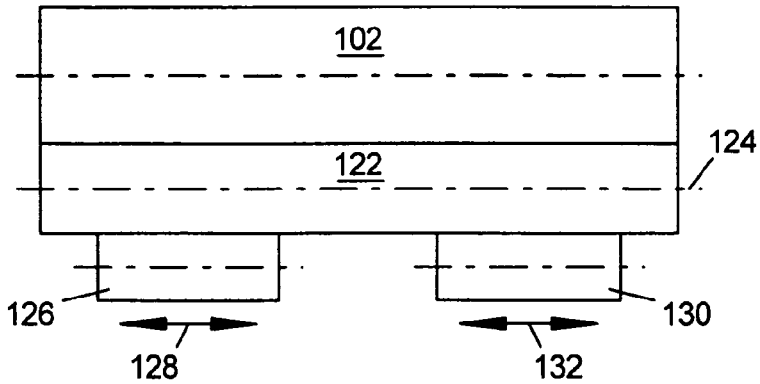
FIG. 5 presents a top view of the FIG. 4 method and apparatus according one configuration.

Referring now to FIGS. 4A and 5, an apparatus and method for applying surface treatment to a fuser is provided. A method and apparatus according to one aspect of the invention comprises contacting the fuser 102 with an applicator 122 defining a longitudinal axis 124, contacting the applicator 122 with an auxiliary applicator 126, and traversing the auxiliary applicator 126 parallel to the longitudinal axis 124, the motion being indicated by arrow 128. The applicator 122 may have an overall length approximately the same as fuser 102. The applicator 122 and auxiliary applicator are preferably cylindrical so they can roll. A method and apparatus according to a further aspect of the invention may comprise contacting the applicator 122 with another auxiliary applicator 130, and traversing the another auxiliary applicator 130 parallel to the longitudinal axis 124, the motion being indicated by arrow 132. As shown in FIG. 4B, the auxiliary applicator 126 and the another auxiliary applicator 130 may be disengaged from the applicator 122, for example while traversing the auxiliary applicators 126 and/or 130 in order to ameliorate surface wear. Preferably, the applicator 122 is disengaged from the fuser 102 at the same time.

Figure 6:
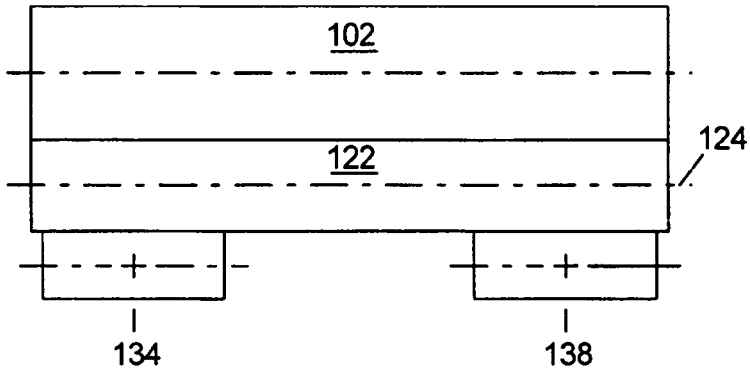
FIG. 6 presents a top view of the FIG. 4 method and apparatus according another configuration.
Figure 7:
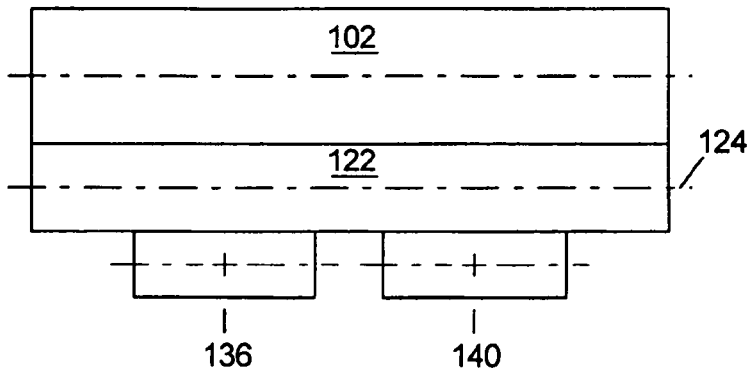
FIG. 7 presents a top view of the FIG. 4 method and apparatus according to further configuration.

As is shown in FIGS. 6 and 7, the auxiliary applicator 126 may be traversed parallel to the longitudinal axis 124 to a first location 134 corresponding to a first media size, and the auxiliary applicator 126 may be traversed parallel to the longitudinal axis 124 to a second location 136 corresponding to a predetermined second media size. Likewise, the another auxiliary applicator 130 may be traversed parallel to the longitudinal axis 124 to another first location 138 corresponding to the first media size, and traversed parallel to the longitudinal axis 124 to another second location 140 corresponding to a second media size. The minimum width of surface treatment application may be greater than the sum of the lengths of the auxiliary applicators 126/130, or the length of the applicator 122 to which surface treatment is applied. Correspondingly, the maximum length may be the sum of the lengths of the auxiliary applicators 126/130 and the length of the applicator 122 to which surface treatment is applied. In a certain embodiment, the width of surface treatment application to the fuser 102 ranges from 8.25 inches to 14.33 inches, although this may be varied without limitation.

Figure 8:
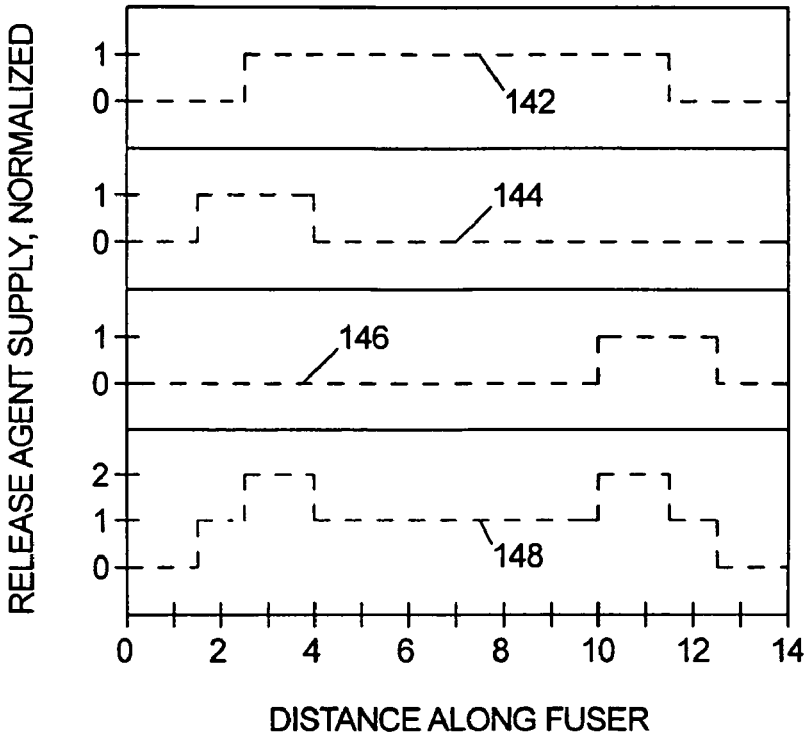
FIG. 8 presents graphical representations of surface treatment supply versus distance along a fuser for one configuration of a method and apparatus according to one aspect of the invention.

Referring now to FIG. 8, surface treatment distribution is presented for various components. A plot 142 of surface treatment supply versus position along the fuser 102 is presented for the applicator 122. An equal amount of surface treatment is applied along the length of the applicator 122 from about the 2.5 inch position to the 11.5 inch position, as indicated by plot 142. A plot 144 of surface treatment supply versus position along the fuser 102 is presented for the auxiliary applicator 126 at a first location corresponding to the first media size, for example 8.5×11 inch media (the eleven inch dimension being parallel to the longitudinal axis 124 of FIGS. 5–7). A plot 146 of surface treatment supply versus position along the fuser 102 is presented for the another auxiliary applicator 130 at another first location corresponding to the first media size, for example 8.5×11 inch media (the eleven inch dimension being parallel to the longitudinal axis 124 of FIGS. 5–7). According to a preferred embodiment, the auxiliary applicator 126 and the another auxiliary applicator 130 are adjacent the end portions of the applicator 122 (as shown in FIGS. 5–7). The surface treatment supplies indicated by plots 142, 144, and 146 complement each other and add together to provide a predetermined surface treatment supply distribution on the surface of the applicator 122, and applied to the fuser 102, as indicated by a plot 148.

Figure 9:
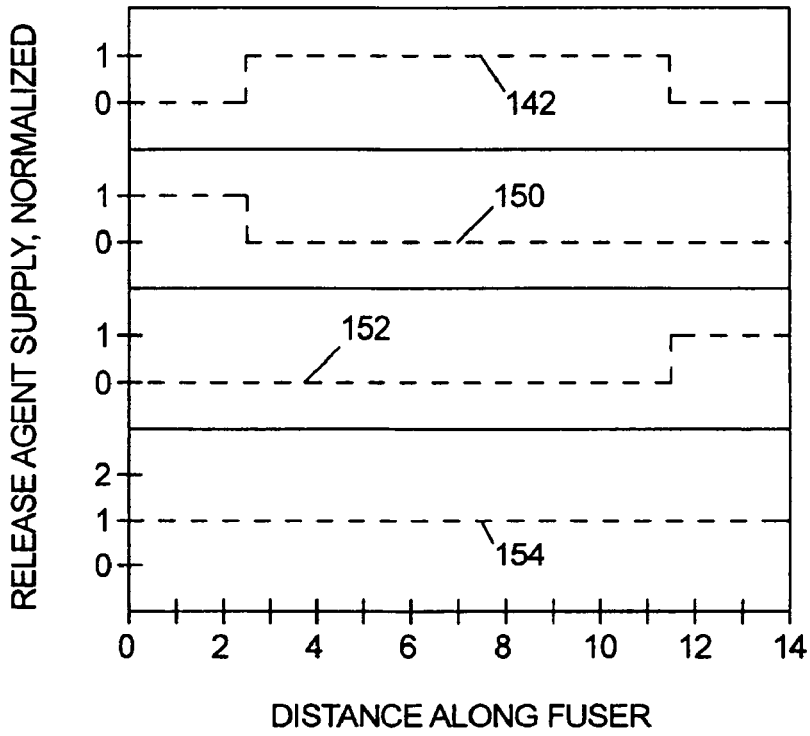
FIG. 9 presents graphical representations of surface treatment supply versus distance along a fuser for another configuration the FIG. 8 method and apparatus.

Referring now to FIG. 9, surface treatment distribution is presented for various components with the auxiliary applicator 126 and the another auxiliary applicator 130 positioned for a different media size. The plot 142 of surface treatment supply versus position along the fuser 102 as presented in the previous figure for the applicator 122 remains unchanged. A plot 150 of surface treatment supply versus position along the fuser 102 is presented for the auxiliary applicator 126 at a second location corresponding to the second media size, for example 8.5×14 inch media (the fourteen inch dimension being parallel to the longitudinal axis 124 of FIGS. 5–7). A plot 152 of surface treatment supply versus position along the fuser 102 is presented for the another auxiliary applicator 130 at another second location corresponding to the second media size, for example 8.5×14 inch media (the fourteen inch dimension being parallel to the longitudinal axis 124 of FIGS. 5–7). In FIG.

9, the predetermined surface treatment distribution is a constant versus position along the longitudinal axis, as indicated by plot 154.

Figure 10:
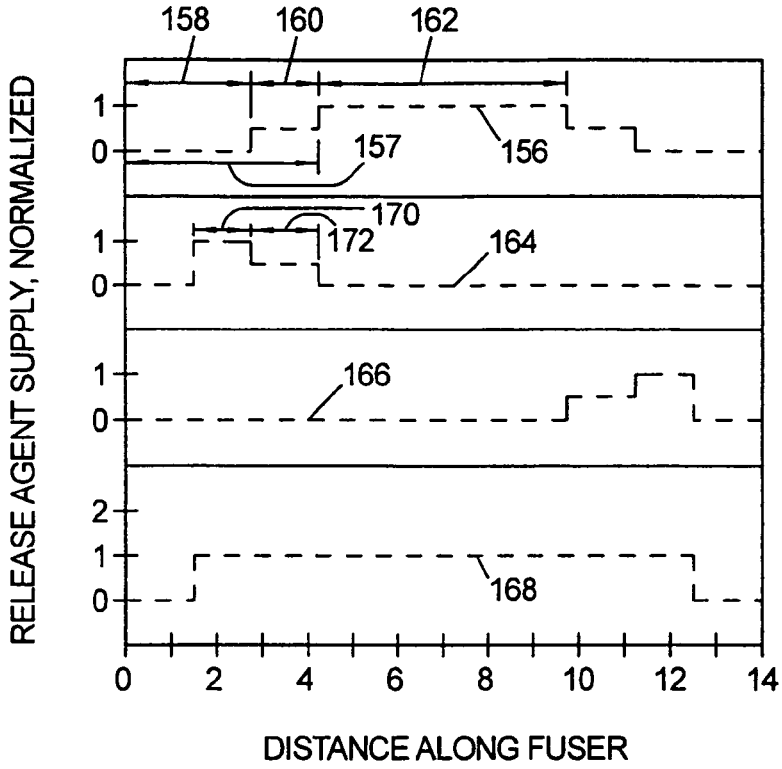
FIG. 10 presents graphical representations of surface treatment supply versus distance along a fuser for one configuration of a method and apparatus according to one aspect of the invention.

Referring now to FIG. 10, surface treatment distribution is presented for various components, according to another embodiment of the invention. A plot 156 of surface treatment supply versus position along the fuser 102 is presented. More surface treatment may be applied to a center portion 162 of the applicator 122 than to an end portion of the applicator 122, as indicated by plot 156. Furthermore, the surface treatment may be applied to the applicator 122 with a stepwise increase in surface treatment supply from an initial section 158 of the end portion comprising no surface treatment supply, to an adjacent section 160 of the end portion comprising an intermediate quantity of surface treatment supply, to the center portion 162 comprising a greater quantity of surface treatment supply.

A plot 164 of surface treatment supply versus position along the fuser 102 is presented for the auxiliary applicator 126 at a first location corresponding to the first media size. More surface treatment may be applied to one portion 170 of the auxiliary applicator 126 than to another portion 172 of the auxiliary applicator 126. The one portion 170 of the auxiliary applicator 126 may be proximate the end portion 157 of the applicator, and the another portion 172 of the auxiliary applicator 170 may be proximate the center portion 162 of the applicator 122. The surface treatment may be applied to the auxiliary applicator 126 with a stepwise decrease in surface treatment supply from the one portion 170 of the auxiliary applicator to the another portion 172 of the auxiliary applicator 126. This generates application of surface treatment from the auxiliary applicator 126 to the applicator 122 with an amount that stepwise decreases with position along the auxiliary applicator 126 from the one portion 170 of the auxiliary applicator 126 to the another portion 172 of the auxiliary applicator 126.

A plot 166 of surface treatment supply versus position along the fuser 102 is presented for the another auxiliary applicator 130 at another first location corresponding to the first media size. The applicator 122 and the another auxiliary applicator 130 are preferably configured such that the surface treatment supply/application is symmetric about the center of the applicator 130. The surface treatment supplies indicated by plots 156, 164, and 166 complement each other and add together to provide a predetermined surface treatment supply distribution on the surface of the applicator 122, and applied to the fuser 102, as indicated by a plot 168. In FIG. 10, the predetermined surface treatment distribution is a constant versus position along the longitudinal axis, as indicated by plot 168, which may be advantageous if the first media size is printed most often.

Figure 11:
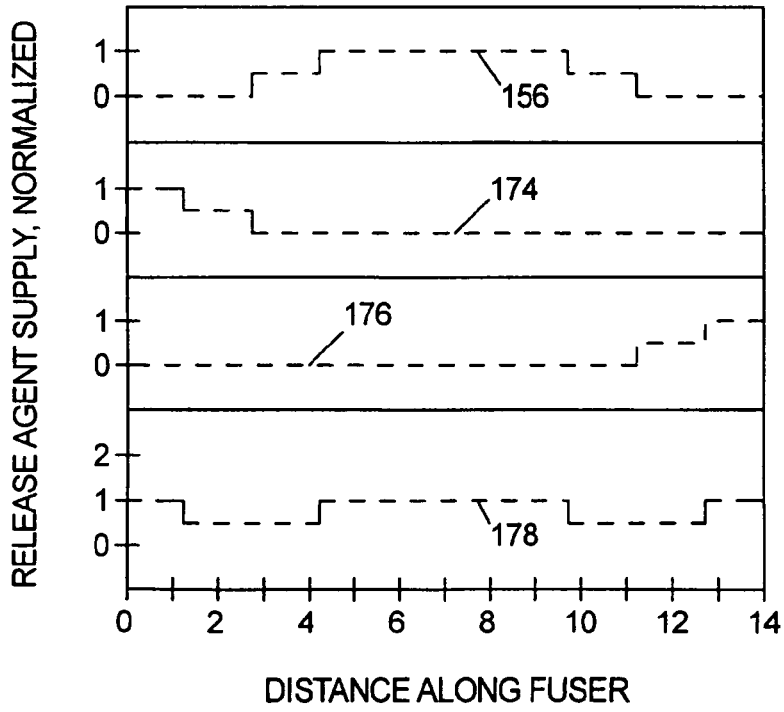
FIG. 11 presents graphical representations of surface treatment supply versus distance along a fuser for another configuration the FIG. 10 method and apparatus.

Referring now to FIG. 11, surface treatment distribution is presented for various components with the auxiliary applicator 126 and the another auxiliary applicator 130 positioned for a different media size. The plot 156 of surface treatment supply versus position along the fuser 102 as presented for the applicator 122 remains unchanged. A plot 174 of surface treatment supply versus position along the fuser 102 is presented for the auxiliary applicator 126 at a second location corresponding to the second media size. A plot 176 of surface treatment supply versus position along the fuser 102 is presented for the another auxiliary applicator 130 at another second location corresponding to the second media size. The surface treatment supply to the fuser 102 is indicated by plot 178.

Figure 12:
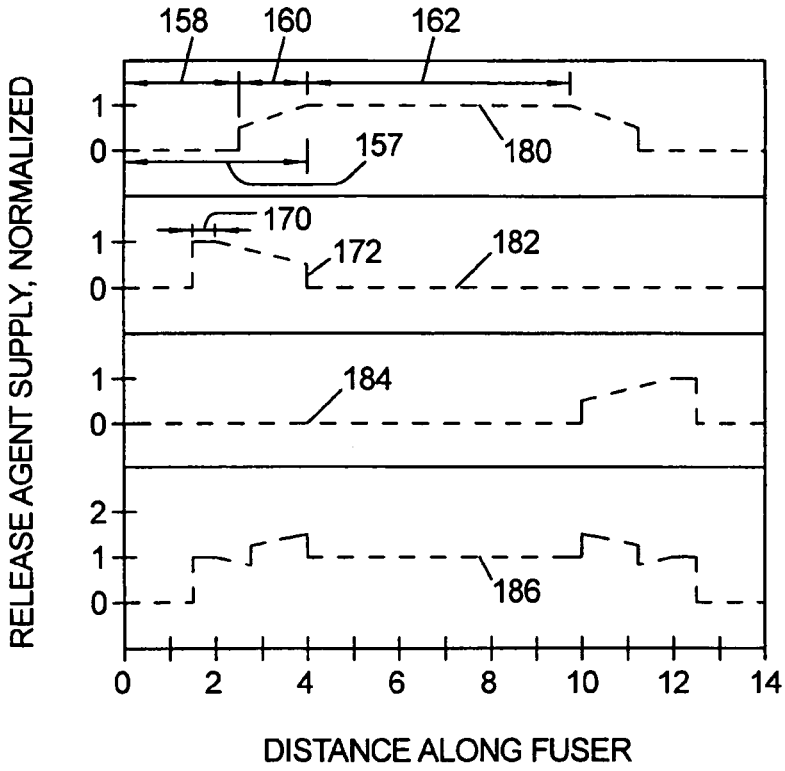
FIG. 12 presents graphical representations of surface treatment supply versus distance along a fuser for one configuration of a method and apparatus according to one aspect of the invention.

Referring now to FIG. 12, surface treatment distribution is presented for various components, according to another embodiment of the invention. A plot 180 of surface treatment supply versus position along the fuser 102 is presented. The surface treatment may be applied to the applicator 122 with a linear increase in surface treatment supply from the initial section 158 of the end portion comprising no surface treatment supply to the center portion 162 comprising a greater quantity of surface treatment supply. A plot 182 of surface treatment supply versus position along the fuser 102 is presented for the auxiliary applicator 126 at a first location corresponding to the first media size. More surface treatment may be applied to one portion 170 of the auxiliary applicator 126 than to another portion 172 of the auxiliary applicator 126. The one portion 170 of the auxiliary applicator 126 may be proximate the end portion 157 of the applicator, and the another portion 172 of the auxiliary applicator 170 may be proximate the center portion 162 of the applicator 122. The surface treatment may be applied to the auxiliary applicator 126 with an amount that linearly decreases with position along the auxiliary applicator 126 from the one portion 126 of the auxiliary applicator to the another portion of the auxiliary applicator 172. This generates application of surface treatment from the auxiliary applicator 126 to the applicator 122 with an amount that linearly decreases with position along the auxiliary applicator 126 from the one portion 170 of the auxiliary applicator 126 to the another portion 172 of the auxiliary applicator 126. A plot 184 of surface treatment supply versus position along the fuser 102 is presented for the another auxiliary applicator 130 at another first location corresponding to the first media size. The applicator 122 and the another auxiliary applicator 130 are preferably configured such that the surface treatment supply/application is symmetric about the center of the applicator 130. The surface treatment supplies indicated by plots 180, 182, and 184 complement each other and add together to provide a predetermined surface treatment supply distribution on the surface of the applicator 122, and applied to the fuser 102, as indicated by a plot 186.

Figure 13:
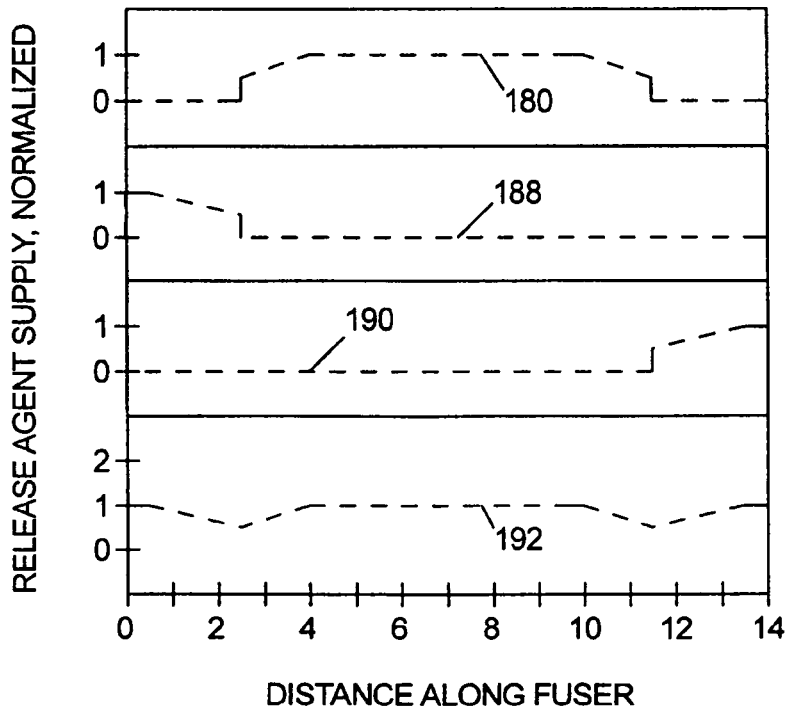
FIG. 13 presents graphical representations of surface treatment supply versus distance along a fuser for another configuration the FIG. 12 method and apparatus.

Referring now to FIG. 13, surface treatment distribution is presented for various components with the auxiliary applicator 126 and the another auxiliary applicator 130 positioned for a different media size. The plot 180 of surface treatment supply versus position along the fuser 102 as presented for the applicator 122 remains unchanged. A plot 188 of surface treatment supply versus position along the fuser 102 is presented for the auxiliary applicator 126 at a second location corresponding to the second media size. A plot 190 of surface treatment supply versus position along the fuser 102 is presented for the another auxiliary applicator 130 at another second location corresponding to the second media size. The surface treatment supply to the fuser 102 is indicated by plot 192.

Although shown with particular combinations of surface treatment application applicator 122, auxiliary applicator 126, and another auxiliary applicator 130 in FIGS. 8–13, any combination is contemplated in the practice of the invention. For example, the stepwise and linearly decreasing surface treatment application with the auxiliary applicators 126 and 130 may be implemented with the linear surface treatment application to the applicator 122 of FIGS. 8 and 9, and vice versa.

Various applicator and auxiliary applicator configurations are useful in the practice of the invention implement metals, plastics, elastomers and/or ceramics. Referring now FIG. 14, and example of a configuration for the applicator and the auxiliary applicator is presented comprising an annular porous core 194 the surface treatment being applied inside the annular porous core 194, for example through a tube 196 having one or more perforations 198. A porous covering 201 may be provided over the porous core 194, for example a fibrous material. Suitable fibrous materials comprise bulk fiber, woven fabrics, and non-woven fabrics, without limitation.

Figure 15:
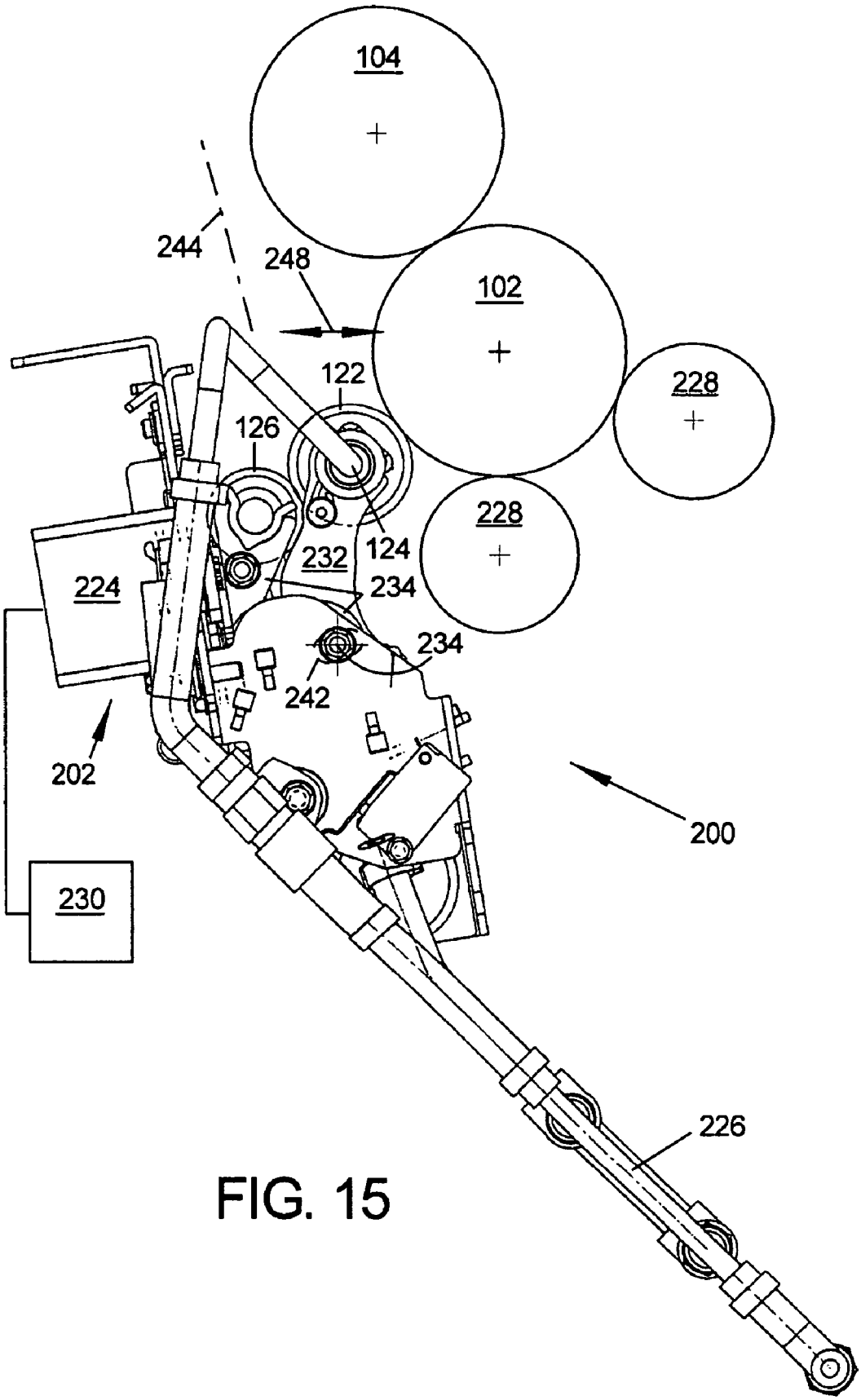
FIG. 15 presents an end view of an embodiment of a method and apparatus according to one aspect of the invention.

Referring now to FIG. 15, an end view of an apparatus 200 for applying surface treatment to the fuser 102 is presented according to a further aspect of the invention. The apparatus 200 comprises the applicator 122 operative to contact the fuser 102. The auxiliary applicator 126 contacts the applicator 122. A traversing mechanism 202 operative to move the auxiliary applicator 126 parallel to the longitudinal axis 124. The traversing mechanism 202 may implement numerous components including motors, stepper motors, pneumatic actuators, gears, pulleys, belts, chains, cams, linkages, worms, lead-screws, etc., as may be desired in order to achieve a particular motion, such variations being well within ordinary skill in the mechanical arts in light of the description provided herein, and may be controlled by a controller 230. The fuser 102 is externally heated by a pair of heater rollers 228, which are heated, for example, by internal heat lamps (not shown) and other suitable methods, without limitation.

Figure 16:
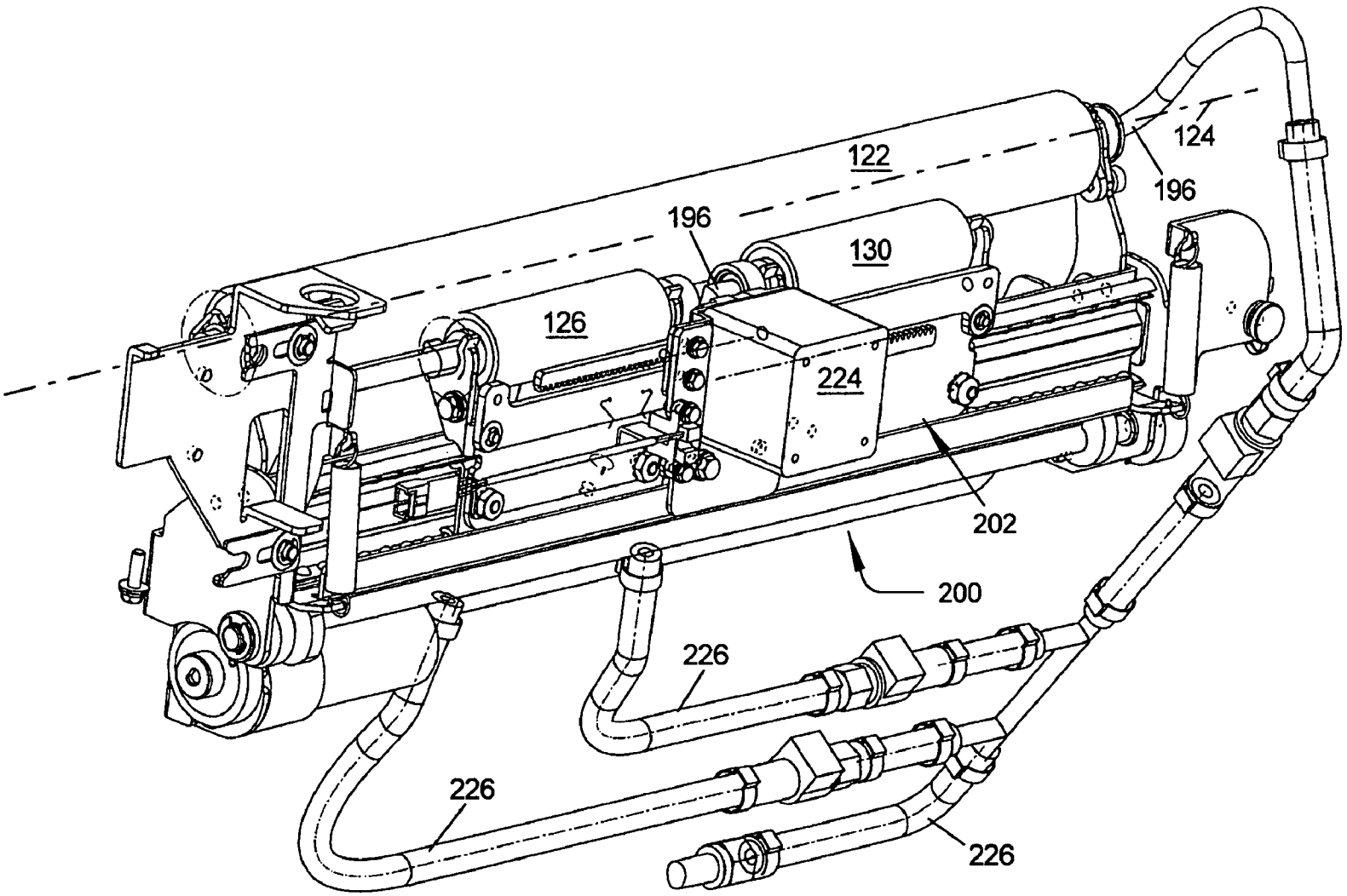
FIG. 16 presents a perspective view of the FIG. 15 method and apparatus.
Figure 17:
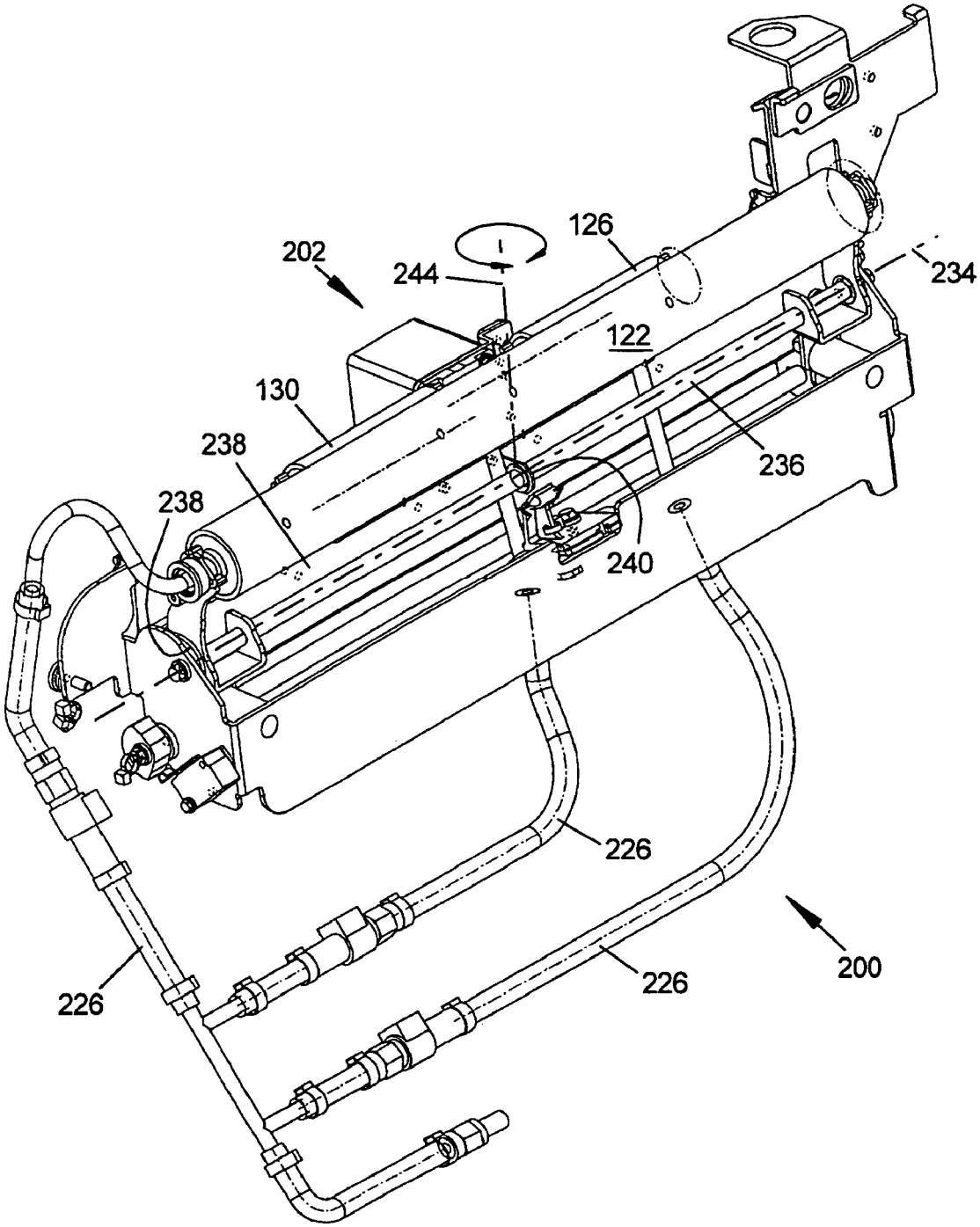
FIG. 17 presents a perspective view of the FIG. 16 from an opposite side as that presented in FIG. 16.

Referring now to FIGS. 16 and 17, perspective views from opposites sides of the apparatus 200 are presented. The apparatus 200 may comprise the another auxiliary applicator 130 contacting the applicator 122, the traversing mechanism 202 being operative to move the another auxiliary applicator 130 parallel to the longitudinal axis 124. Flexible tubes 226 are provided to supply surface treatment to the applicator 122, auxiliary applicator 126, and the another auxiliary applicator 130 (portions of the tubes are now shown in FIGS. 16 and 17 in order avoid obscuring other structure). The flexibility of the tubes 226 allows the assembly 200 to move, and the auxiliary applicator 126 and the another auxiliary applicator 130 to translate with reasonable force. In the example presented, the applicator is rotatable and is driven at the interface with the fuser 102 by friction. Similarly, the auxiliary applicator 126 and the another auxiliary applicator 130 are rotatable and are driven at their interface with the applicator 122. Rotating seals are provided on the applicator 122, the auxiliary applicator 126, and the another auxiliary applicator 130 in order to allow feed of surface treatment to these components without leakage. A pump or other means (not shown) is provided to regulate the rate of flow of surface treatment.

Referring now to FIGS. 15 and 17, the applicator 122 is carried on an applicator carriage 232. The applicator carriage 232 rotates about pivot 234 by way of an axle 236. The traversing mechanism 202 comprises a frame 238. A clevis 240 is captive on the axle 236 and fixed to the frame 283 (best shown in FIG. 17). Opposing ends of the frame 238 are provided with an elongate slot 242 (shown hidden in FIG. 15). The combined effect of these features permits the traversing mechanism 202 to rotate about a gimbal axis 244. The gimbal facilitates full contact of the auxiliary applicator 126 and the another auxiliary applicator 130 to the applicator 122 with an approximately equal pressure.

The applicator 122 may be unloaded and loaded from and to the fuser 102 by pivoting the applicator carriage 232 about the pivot 234 with a motor and a suitable linkage, not shown, as indicated by arrow 248.

Figure 21:
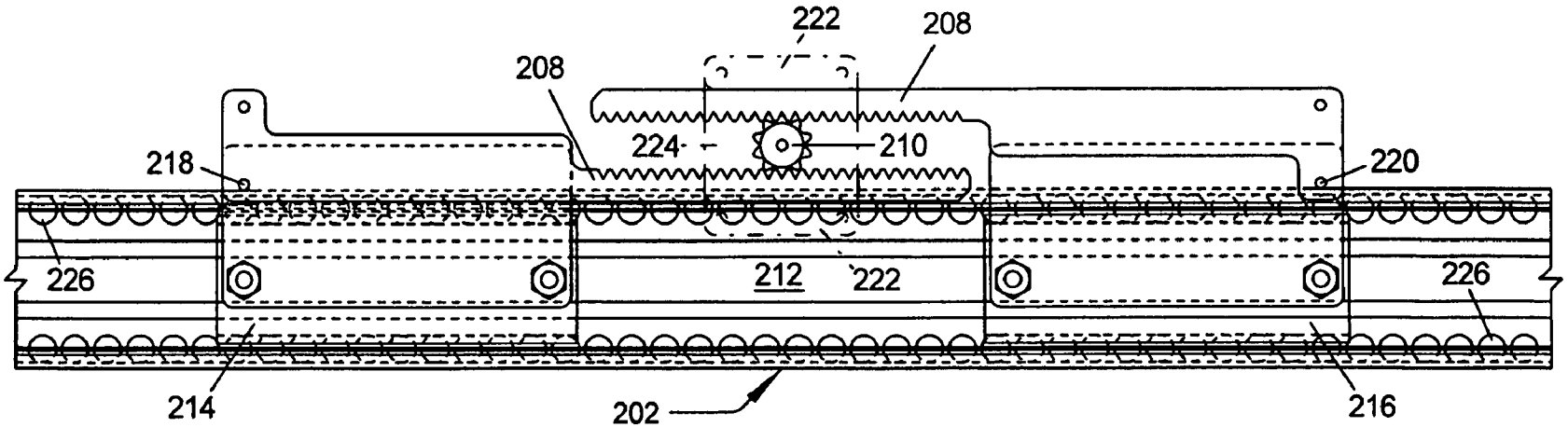
FIG. 21 presents a detailed front of view of a traversal mechanism, according to one embodiment of the invention.
Figure 23:
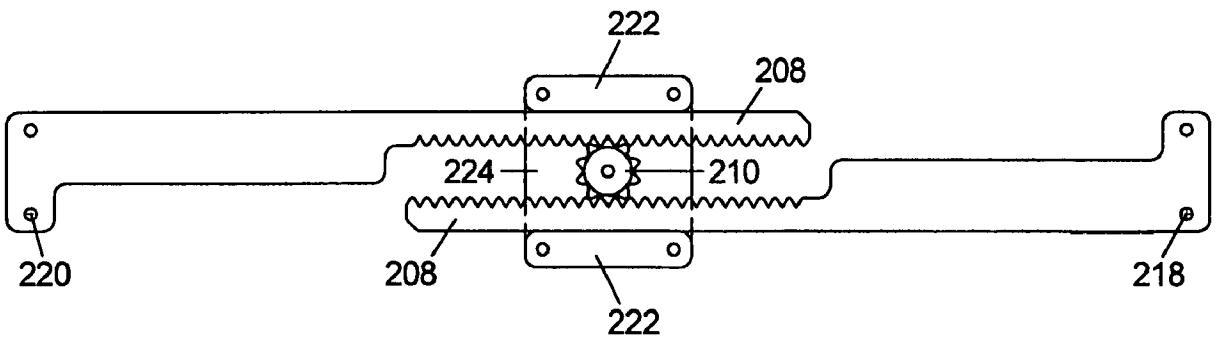
FIG. 23 presents detailed view of portions of the FIG. 21 traversal mechanism from the opposite side of FIG. 21.
Figure 22:
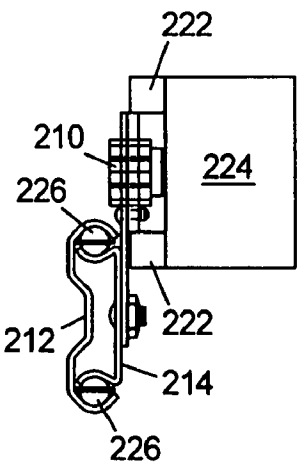
FIG. 22 presents a side detailed view (left elevation) of the FIG. 21 traversal mechanism.

Detailed views of the traversing mechanism 202 are presented in FIGS. 21–23. The traversing mechanism 202 comprises a pair of opposing racks 208 aligned with the longitudinal axis 124 and a pinion 210 interposed between the racks 208. A stepper motor 211 is operative to drive the pinion 210, for example by a motor shaft pressed into the pinion 210. A slide 212 and an auxiliary applicator carriage 214 carried on the slide 212 are provided. The slide 212 is fastened or otherwise fixed to the frame 238 (FIGS. 15 and 17). The auxiliary applicator 126 is carried on the auxiliary applicator carriage 214. Another auxiliary applicator carriage 216 is carried on the slide 212, and the another auxiliary applicator 130 is carried on the another auxiliary applicator carriage 216. The slide 212 comprises a multitude of ball bearings 226. One of the opposing racks 208 is pivotally mounted at pivot 218 to the auxiliary applicator carriage 214 and another of the opposing racks 208 is pivotally mounted at pivot 220 to the another auxiliary applicator carriage 216. A pair of guides 222 is positioned to maintain the opposing racks 208 in contact with the pinion 210. A stepper motor 224 drives the pinion 210, and the pair of stops 222 may be attached to the stepper motor 224 (the stepper motor 224 is shown in phantom in FIG. 21 in order to avoid obstructing the view).

Figure 19:
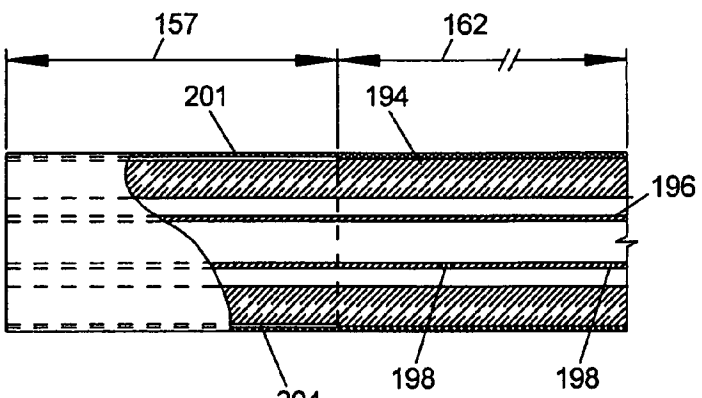
FIG. 19 presents a side view of a one embodiment of a suitable construction for an applicator, with portions broken away.
Figure 20:
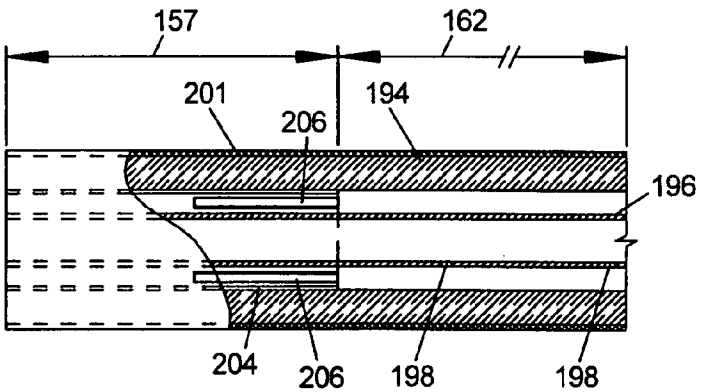
FIG. 20 presents a side view of a one embodiment of a suitable construction for an applicator, with portions broken away.
Figure 18:
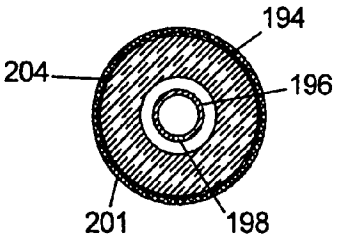
FIG. 18 presents a cross-sectional view of one embodiment of a suitable construction for an applicator.

Referring now to FIGS. 18 and 19, end and side views of the applicator 122 are presented according to a further aspect of the invention. The applicator 122, the auxiliary applicator 126, and/or the another auxiliary applicator 130 may be at least partially porous. According to one embodiment, the applicator 122 comprises the porous core 194, the end portion 157 and the center portion 162. An impervious coating 204 is provided on the end portion 157. The impervious coating 204 may be on the inside and/or outside of the porous core 194, but putting the coating on the outside is easier. A coating on the inside may be advantageous depending upon the surface treatment distribution desired, for example that presented in FIGS. 12 and 13. The porous covering 201 may cover at least part of the porous core 194. The auxiliary applicator 126 and/or the another auxiliary applicator 130 and any further applicators and auxiliary applicators may be configured in like manner. As shown in FIGS. 18 and 19, the impervious coating 204 generates a stepwise distribution in surface treatment supply or application. Referring now to FIG. 20, surface treatment supply may be altered by providing slots 206. Various distributions may be generated by appropriately arranging and dimensioning the slots 206. Different geometries for the slots 206 may be implemented, for example trapezoidal or triangular slots, without limitation. An array of holes or other varying porosity in the impervious coating 204 may also be implemented in order to provide a desired surface treatment distribution, for example the distribution shown in FIGS. 10 through 13. A slotted wick roller is disclosed in U.S. Pat. No. 6,317,577 B1 issued to Baruch et al. on Nov. 13, 2001, entitled METHOD AND IMPROVED WICK ROLLER FOR CONTROLLING THE DISTRIBUTION OF FUSER OIL ON A FUSER SURFACE, the contents of which are hereby incorporated by reference as if fully set forth herein.

A predetermined distribution may also be generated by appropriately spacing the perforations 198 along the length of the supply tube 196. For example, surface treatment supply may be increased over the center portion 162 relative to the end portion 157 by placing perforations 198 closer together in the center portion 162 than in the end portion 157 (that also included placing more perforations 198 in the center portion), for example to achieve the distribution shown in FIGS. 12 and 13.

The porous material in the porous core 194 may be any suitably porous material which is stable at the temperature of the applicator 122 and which functions to permit surface treatment to wick through the porous material as the applicator 122 rotates. One suitable material is porous alumina/ silica carbide. The surface treatment may be a release agent supplied to the cavity 34 in a quantity on the order of 0.5 to 10 microliters per copy processed by the fuser, and may be on the order of 0.5 to about 3 microliters per copy. Typical surface treatments are silicone oils which have viscosities from about 100 to about 100,000 centistokes and preferably from about 10,000 to about 80,000 centistokes at 70° F. and may include electrostatic control agents or other additives known to those skilled in the art to facilitate the release of marking material from fuser 102.

Typically end caps are sealingly positioned over each end of the applicator 122, auxiliary applicator 126, and the another auxiliary applicator 130. The oil impervious coating 204 may be any suitable material which is impervious to the oil used at the temperatures and pressures encountered. One suitable material is marketed under the trademark MAGNA-BOND by Crossfield Products Corporation, 2153 Sacramento Street, Los Angeles, Calif.

A suitable material for the porous covering 201 is an aramid fiber material supplied under the trademark NOMEX by Dupont de Nemours & Company, 1007 Market Street, Wilmington, Del. The exposed surface is singed to remove loose fiber ends and to increase friction implemented to drive the applicator 122, the auxiliary applicator 126, and the another auxiliary applicator 130.

Typically the surface of fuser 102 is heated to a temperature from about 330 to about 385° F. The use of the oil as discussed above is effective with silicone rubbers and will be useful with other materials, as is well known to those skilled in the art. As mentioned above, the surface treatment is typically silicone oil having a viscosity between 100 and 100,000 centistokes at 70° F. A suitable oil is marketed under the trademark DC 200 by Dow Corning, Midland, Mich. A typical additive for use with such oils is marketed under the trademark SILWET by Union Carbide Corporation, Old Ridgebury Road, Danbury, Conn.

In a certain embodiment, the applicator 122 is about 14.4 inches long, and the end portions are coated between the core and covering, as just described, so the surface treatment is limited to the center portion 162 of about 8.3 inches in length. A stepwise distribution is implemented, and the auxiliary applicator 126 and the another auxiliary applicator are about 3.1 inches in length with uniform release application over their entire lengths. This produces the surface treatment distributions presented in FIGS. 8 and 9. This embodiment is particularly advantageous for a center registered printer, where changes in paper size require equal oil width adjustment about a paper centerline. There is a relationship between the lengths of the applicator and auxiliary applicators, which enables the most even application of oil obtainable by the invention. Specifically, the oiled length of the applicator 122 is wider than the combined oiled lengths of the auxiliary applicators 126 and 130 plus the distance between the auxiliary applicators 126 and 130 when they are at the minimum spacing. In addition, the combined oiled widths of the applicator 122 and auxiliary applicators 126 and 130 must meet or exceed the widest paper, with some overlap to account for tolerances. It is recognized that other combinations may be used in other embodiments to accommodate other specific ranges of paper width. The auxiliary applicators 126 and 130 may overlap. It is further recognized that the applicator 122 and only one auxiliary applicator 126 may be implemented for an application in which the media is edge registered.

As described, oil is supplied internally to the applicator 122 and auxiliary applicators 126 and 130 by distribution tubes disposed inside these components. The relative flow of oil to the 3 wicks may be controlled by the number of holes in each distribution tube, which impose a very large resistance to oil flow, and may thus be "tuned" for a particular ratio of oil flow. The desired oil flow into each applicator 122 and auxiliary applicators 126 and 130 is proportional to the applicator oiled length. Thus, only one oil pump, and no oil control devices such as solenoids may be implemented. It is recognized that other embodiments may have a different number of holes in each distribution tube, or add solenoids in the oil lines leading to the distribution tubes or a plurality of pumps to generate a preferred ratio of oil supplied to each applicator 122 and auxiliary applicators 126 and 130. Pertinent information regarding surface treatment applicators is disclosed in U.S. Pat. Nos. 5,235,394, 5,267,004 and 5,732,317, the contents of which are fully incorporated by reference as if set forth herein.

In a preferred embodiment, the applicator 122 is pressed against the fuser 102 only when the fuser 102 is in operation, that is when it is used to fuse marking material to a substrate, usually paper. (During standby, the applicator 122 is separated from the fuser 102, so that no oil is applied to the fuser 102.) The auxiliary applicators 126 and 130 are pressed against the applicator 122 at all times by springs, with a force that is sufficient to transfer oil to the surface of the main wick, and to cause the auxiliary applicators 126 and 130 to be driven rotatably by the applicator 122, which is driven rotatably by the fuser 102. We have found the auxiliary applicators 126 and 130 are translatable, even when pressed against the main wick. In this manner, the auxiliary applicators may be adjusted while the fuser 102 is in operation, if paper size is changed in the middle of a print run. Other embodiments within the scope of the invention can separate the applicator 122 and auxiliary applicators 126 and 130 during standby, if an advantage is gained from doing so.

A porous covering 201 on applicator 122, for example felt, may absorb some amount of surface treatment when wider paper is run. This surface treatment may be applied to the fuser 102 even when narrower paper is run, which may be undesirable. Changing the material on "donor" sections (only) of the applicator 122, to one that is non-absorbent may minimize the amount of residual surface treatment on those sections of the applicator 122.

Figure 24:
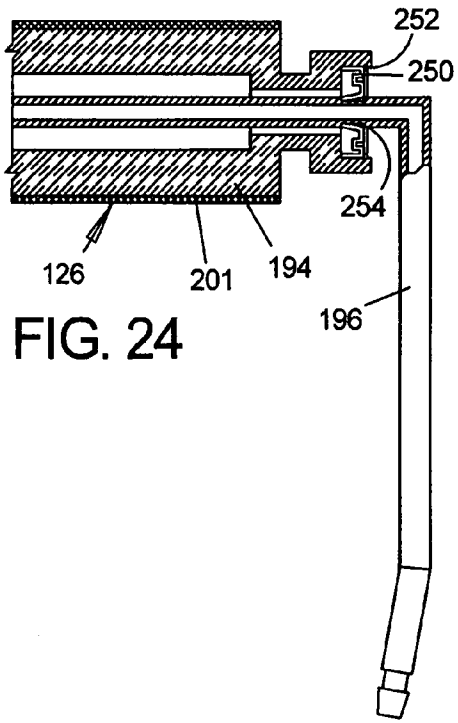
FIG. 24 presents a partial cross-sectional view of an auxiliary applicator.

Referring now to FIG. 24, a partial cross-sectional view is presented, with parts broken away, of the auxiliary applicator 126 comprising the annular porous core 194 and porous covering 201. The surface treatment supply tube 196 enters the annular porous core 194 through a rotary seal 250 held in place by a snap ring 252 and a mating groove in the core 194. The tube 196 comprises a recess 254 on its outside diameter that mates with the rotary seal 250. The tube 196 is held to the frame 238 (FIGS. 15 and 17) by a clip (not shown).

Applicators and auxiliary applicators other than those specifically described herein are contemplated in the practice of the invention. For example, without limitation, they may be comprised of an elastomer coated metal core, the surface treatment may be applied by a wick or a pan, and a doctor blade may be used to squeegee or otherwise control the thickness of the surface treatment.

The basic control strategy for positioning the adjustable wicks may be a closed loop sensing scheme. The paper size signal may come from the position of the media guides on the media supply in use and may then be used to position the auxiliary applicators 126 and 130 in a predetermined manner. Sensors may also be implemented to sense the width of the media. A paper catalogue and job scheduling may also be implemented to determine the width of the media since the paper catalogue may be used to determine the characteristics of each individual sheet, and job scheduling tracks the sheet throughout the machine. As such, the characteristics of each and every sheet approaching the fuser may be determined. Concepts relating to scheduling and jam recovery are described in U.S. patent application Ser. No. 10/673,602 entitled "Ordered Media Jam Recovery System and Method", filed Sep. 29, 2003, the contents of which are incorporated by reference as if fully set forth herein. In addition, the actual auxiliary applicator position may also be sensed, and fed back to the motion control software, to insure proper positioning of the auxiliary applicators 126 and 130. Of course, combinations of these are contemplated in the practice of the invention.

The concepts described herein are equally applicable to other fuser configurations, such as a fuser belt. A fuser belt system is disclosed in U.S. Pat. No. 6,096,427 issued Aug. 1, 2000 to Chen et al. This patent is hereby incorporated in its entirety by reference as if fully set for herein.

As used herein "fuser" and "fusing" refers to apparatus and processes for stabilizing an image on a receiver by heat and/or pressure. The image may be rendered by inkjet, electrographic, or other means that apply marking material 108 to the sheet 106. The marking material 108 may comprise ink, dye, and/or toner. The particular type of marking material 108 is not critical in the practice of the invention.

A controller and supporting software, not shown, are implemented to control the various functions described herein. Such implementation is well within ordinary skill in the relevant art. It should be understood that the programs, processes, methods and apparatus described herein are not related or limited to any particular type of computer or network apparatus (hardware or software), unless indicated otherwise. Various types of general purpose or specialized computer apparatus may be used with or perform operations in accordance with the teachings described herein. The control implementation may be expressed in software, hardware, and/or firmware.

Although the invention has been described and illustrated with reference to specific illustrative embodiments thereof, it is not intended that the invention be limited to those illustrative embodiments. Those skilled in the art will recognize that variations and modifications can be made without departing from the true scope and spirit of the invention as defined by the claims that follow. It is therefore intended to include within the invention all such variations and modifications as fall within the scope of the appended claims and equivalents thereof. The claims should not be read as limited to the described order or elements unless stated to that effect. In addition, use of the term "means" in any claim is intended to invoke 35 U.S.C. §112, paragraph 6, and any claim without the word "means" is not so intended.

PARTS LIST

100 fuser assembly
102 fuser roller
104 pressure roller
106 media
108 toner
110 arrow
112 width
114 another media
116 width
118 width of release agent application
120 different width of release agent application
122 applicator
124 longitudinal axis
126 auxiliary applicator
128 motion being indicated by arrow
130 another auxiliary applicator
132 motion being indicated by arrow
134 first location
136 second location
138 another first location
140 another second location
142 plot
144 plot
146 plot
148 plot
150 plot
152 plot
154 plot
156 plot
157 end portion
158 initial section
160 adjacent section
162 center portion
164 plot
166 plot
168 plot
170 one portion
172 another portion
174 plot
176 plot
178 plot
180 plot
182 plot
184 plot
186 plot
188 plot
190 plot
192 plot
194 annular porous core
196 tube
198 perforations
201 porous covering
200 apparatus
202 traversing mechanism
204 impervious coating
206 slots
208 pair of opposing racks
210 pinion
211 motor
212 slide
214 auxiliary applicator carriage
216 another auxiliary applicator carriage
218 pivot
220 pivot
222 pair of stops
224 stepper motor
226 flexible tubes
228 heater rollers
230 controller
232 applicator carriage
234 pivot point
236 axle
238 frame
240 clevis
242 elongate slot
244 gimbal axis
248 arrow

250 rotary seal
252 snap ring
254 recess

The invention claimed is:

1. A method of applying surface treatment to a fuser, comprising:

contacting the marking particle fuser with an applicator defining a longitudinal axis;

contacting the applicator with an auxiliary applicator; and traversing the auxiliary applicator parallel to the longitudinal axis.

2. The method of claim 1, comprising:

traversing the auxiliary applicator parallel to the longitudinal axis to a first location corresponding to a first media size; and traversing the auxiliary applicator parallel to the longitudinal axis to a second location corresponding to a second media size.

3. The method of claim 1, comprising:

contacting the applicator with another auxiliary applicator; and traversing the another auxiliary applicator parallel to the longitudinal axis.

4. The method of claim 3, comprising:

traversing the auxiliary applicator parallel to the longitudinal axis to a first location corresponding to a first media size;

traversing the auxiliary applicator parallel to the longitudinal axis to a second location corresponding to a second media size;

traversing the another auxiliary applicator parallel to the longitudinal axis to a another first location corresponding to the first media size; and traversing the another auxiliary applicator parallel to the longitudinal axis to another second location corresponding to a second media size.

5. The method of claim 1, comprising:

applying more surface treatment to one portion of the auxiliary applicator than to another.

6. The method of claim 1, comprising:

applying more surface treatment to a center portion of the applicator than to an end portion of the applicator;

the auxiliary applicator being adjacent the end portion.

7. The method of claim 1, comprising:

applying more surface treatment to one portion of the auxiliary applicator than to another portion of the auxiliary applicator.

8. The method of claim 1, the applicator comprising an annular porous core; and comprising applying more surface treatment to a center portion of the applicator than to an end portion of the applicator, the surface treatment being applied inside the annular porous core.

9. The method of claim 1, the applicator comprising an annular porous core; and comprising applying more surface treatment to a center portion of the applicator than to an end portion of the applicator, the surface treatment being applied inside the annular porous core;

applying more surface treatment to one portion of the auxiliary applicator than to another portion of the auxiliary applicator;

the auxiliary applicator being adjacent the end portion;

the applicator and the auxiliary applicator complementing each other to provide a predetermined surface treatment distribution on the applicator.

10. The method of claim 9, the predetermined surface treatment distribution being a constant versus position along the longitudinal axis.

11. The method of claim 9, the applying more surface treatment to one portion of the auxiliary applicator than to another portion of the auxiliary applicator comprising:

applying surface treatment to the applicator with a stepwise increase in surface treatment supply from an initial section of the end portion comprising no surface treatment supply to the annular porous core, to an adjacent section of the end portion comprising an intermediate quantity of surface treatment supply to the annular porous core, to the center portion comprising a greater quantity of surface treatment supply to the annular porous core.

12. The method of claim 11, comprising:

the one portion of the auxiliary applicator being proximate the end portion of the applicator;

the another portion of the auxiliary applicator being proximate the center portion of the applicator; and applying surface treatment to the auxiliary applicator with a stepwise decrease in surface treatment supply from the one portion of the auxiliary applicator to the another portion of the auxiliary applicator.

13. The method of claim 9, the applying more surface treatment to one portion of the auxiliary applicator than to another portion of the auxiliary applicator comprising:

applying surface treatment from the auxiliary applicator to the applicator with an amount that stepwise decreases with position along the auxiliary applicator from the one portion of the auxiliary applicator to the another portion of the auxiliary applicator.

14. The method of claim 13, comprising:

the one portion of the auxiliary applicator being proximate the end portion of the applicator;

the another portion of the auxiliary applicator being proximate the center portion of the applicator; and applying surface treatment from the auxiliary applicator to the applicator with an amount that linearly decreases with position along the auxiliary applicator from the one portion of the auxiliary applicator to the another portion of the auxiliary applicator.

15. The method of claim 1, comprising:

applying more surface treatment to a center portion of the applicator than to an end portion of the applicator;

applying more surface treatment to one portion of the auxiliary applicator than to another portion of the auxiliary applicator;

the auxiliary applicator being adjacent the end portion;

the applicator and the auxiliary applicator complementing each other to provide a first predetermined surface treatment distribution on the applicator for a first media size and a second predetermined surface treatment distribution on the applicator for a second media size.

16. The method of claim 10, comprising:

the first predetermined size being 8.5 inch×11 inch paper.

17. The method of claim 10, comprising:

the first predetermined size being A4 paper.

18. An apparatus for applying surface treatment to a fuser, comprising:

an applicator operative to contact the fuser and defining a longitudinal axis;

an auxiliary applicator contacting the applicator; and, a traversing mechanism operative to move the auxiliary applicator parallel to the longitudinal axis.

19. The apparatus of claim 18, comprising:

a fibrous material covering on said applicator and said auxiliary applicator.

20. The apparatus of claim 18, comprising:

a fibrous material having a singed outer surface covering on said applicator and said auxiliary applicator.

21. The apparatus of claim 18, comprising:

another auxiliary applicator contacting the applicator;

the traversing mechanism being operative to move the another auxiliary applicator parallel to the longitudinal axis.

22. The apparatus of claim 18, comprising an auxiliary surface treatment supply tube attached to the auxiliary applicator for movement therewith.

23. The apparatus of claim 18, the applicator being at least partially porous;

the auxiliary applicator being at least partially porous.

24. The apparatus of claim 18, the applicator comprising a porous core having an end portion and a center portion;

comprising an impervious coating on the end portion; and the auxiliary applicator being adjacent the end portion.

25. The apparatus of claim 18, the applicator comprising a porous core having an end portion and a center portion;

comprising an impervious coating on the end portion; and the auxiliary applicator being at least partially porous and adjacent the end portion.

26. The apparatus of claim 18, the applicator comprising a porous core having an end portion and a center portion;

comprising an impervious coating on the end portion;

the auxiliary applicator being adjacent the end portion and comprising an auxiliary porous core; and comprising fibrous material covering at least part of the porous core and the auxiliary porous core.

27. A surface treatment applicator for a fuser, comprising:

an applicator operative to contact the marking particle fuser and defining a longitudinal axis;

an auxiliary applicator contacting the applicator proximate an end of the applicator;

another auxiliary applicator contacting the applicator proximate an opposite end of the applicator; and, a traversing mechanism operative to move the auxiliary applicator and the another auxiliary applicator parallel to the longitudinal axis, the traversing mechanism comprising a pair of opposing racks aligned with the longitudinal axis and a pinion interposed between the racks.

28. The apparatus of claim 27, comprising a stepper motor operative to drive the pinion.

29. The apparatus of claim 27, the traversing mechanism comprising:

a slide;

an auxiliary applicator carriage carried on the slide, the auxiliary applicator being carried on the auxiliary applicator carriage; and another auxiliary applicator carriage carried on the slide, the another auxiliary applicator being carried on the another auxiliary applicator carriage.

30. The apparatus of claim 28, one of the opposing racks being pivotally mounted to the auxiliary applicator carriage and another of the opposing racks being pivotally mounted to the another auxiliary applicator carriage; and comprising a pair of stops positioned to restrain the opposing racks in contact with the pinion.

31. The apparatus of claim 30, the traversing mechanism comprising a stepper motor, the pair of stops being attached to the stepper motor.

* * * * *